US011560890B2

(12) United States Patent
DeHoff et al.

(10) Patent No.: US 11,560,890 B2
(45) Date of Patent: Jan. 24, 2023

(54) SPLIT POWER GEROTOR PUMP

(71) Applicant: Schaeffler Technologies AG & Co. KG, Herzogenaurach (DE)

(72) Inventors: Kyle DeHoff, Canal Fulton, OH (US); Joshua Hixenbaugh, Wooster, OH (US); Jeffrey Hemphill, Copley, OH (US); Todd Sturgin, Wooster, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 269 days.

(21) Appl. No.: 16/990,280

(22) Filed: Aug. 11, 2020

(65) Prior Publication Data

US 2021/0048022 A1 Feb. 18, 2021

Related U.S. Application Data

(60) Provisional application No. 62/887,750, filed on Aug. 16, 2019.

(51) Int. Cl.
*F04C 2/10* (2006.01)

(52) U.S. Cl.
CPC ..... *F04C 2/10* (2013.01); *F04C 2240/40* (2013.01); *F04C 2240/50* (2013.01); *F04C 2240/603* (2013.01)

(58) Field of Classification Search
CPC ..... F04C 2/10; F04C 240/40; F04C 2240/50; F04C 2240/603
See application file for complete search history.

(56) References Cited

U.S. PATENT DOCUMENTS

| | | | | |
|---|---|---|---|---|
| 4,627,801 | A * | 12/1986 | Wusthof | F01C 1/113 418/61.3 |
| 4,639,202 | A * | 1/1987 | Mahanay | F01C 20/22 417/406 |
| 2011/0217192 | A1* | 9/2011 | Rosalik, Jr. | F04C 2/10 418/61.3 |
| 2014/0083086 | A1* | 3/2014 | Forssell | F01C 1/10 418/61.3 |
| 2017/0058895 | A1* | 3/2017 | Schultz | F04C 15/0073 |
| 2017/0328362 | A1 | 11/2017 | Hemphill et al. | |
| 2018/0066655 | A1* | 3/2018 | Kowalski | F04C 2/102 |
| 2018/0209417 | A1* | 7/2018 | Aleker | F04C 2/102 |
| 2019/0301456 | A1 | 10/2019 | Hemphill et al. | |

* cited by examiner

*Primary Examiner* — Connor J Tremarche

(57) ABSTRACT

A gerotor pump includes an inner gerotor, a wobble cancellation element, and an outer gerotor disposed radially between the inner gerotor and the wobble cancellation element. The inner gerotor includes a first outer peripheral surface with n first lobes equally spaced from one another in a circumferential direction, and n first depressions, each disposed between an adjacent pair of first lobes. The inner gerotor and the wobble cancellation element are coaxial. The wobble cancellation element includes a first inner peripheral surface with n+1 second lobes equally spaced from one another in the circumferential direction, and n+1 arcuate surfaces, each arranged between an adjacent pair of second lobes. The outer gerotor includes a second outer peripheral surface including n+1 outer depressions complementary to and arranged to engage the second lobes, and a second inner peripheral surface comprising n+1 inner depressions complementary to and arranged to engage the first lobes.

20 Claims, 4 Drawing Sheets

SPLIT POWER GEROTOR PUMP

TECHNICAL FIELD

The present disclosure relates generally to a gerotor pump, and more specifically to a split power gerotor pump.

BACKGROUND

Gerotor pumps with integrated motors are shown in United States Patent Application Publication Nos. 2017/328,362 titled INTEGRATED ECCENTRIC MOTOR AND PUMP and 2019/301,456 titled INTEGRATED MOTOR AND PUMP INCLUDING RADIALLY MOVABLE OUTER GERATOR, both of which are hereby incorporated by reference as if set forth fully herein.

SUMMARY

Example aspects broadly comprise a gerotor pump including an inner gerotor, a wobble cancellation element, and an outer gerotor disposed radially between the inner gerotor and the wobble cancellation element. The inner gerotor includes a first rotational axis and a first outer peripheral surface. The first outer peripheral surface includes n first lobes equally spaced from one another in a circumferential direction, and n first depressions, each disposed between an adjacent pair of first lobes. The wobble cancellation element includes a second rotational axis aligned with the first rotational axis such that the inner gerotor and the wobble cancellation element are coaxial, and a first inner peripheral surface. The first inner peripheral surface includes n+1 second lobes equally spaced from one another in the circumferential direction, and n+1 arcuate surfaces, each arranged between an adjacent pair of second lobes. The outer gerotor includes a second outer peripheral surface including n+1 outer depressions complementary to and arranged to engage the second lobes, and a second inner peripheral surface comprising n+1 inner depressions complementary to and arranged to engage the first lobes.

In an example embodiment, each of the outer depressions of the outer gerotor remains aligned with a same second lobe of the wobble cancellation element when the inner gerotor is rotated relative to the wobble cancellation element. In an example embodiment, each of the inner depressions of the outer gerotor translates between different first lobes of the inner gerotor when the inner gerotor is rotated relative to the wobble cancellation element. In an example embodiment, the outer gerotor is free to float between the inner gerotor and the wobble cancellation element. In an example embodiment, during operation of the gerotor pump, the outer gerotor translates rotationally when the wobble cancellation element is rotated and the inner gerotor is fixed, and the outer gerotor moves but does not translate rotationally when the inner gerotor is rotated and the wobble cancellation element is fixed.

In some example embodiments, the inner gerotor includes a first swash plate with a first radial wall that radially overlaps the second lobes and the arcuate surfaces of the wobble cancellation element, and n first fluid ports disposed in the first radial wall, each one of the n first fluid ports radially aligned with a one of the first lobes. In some example embodiments, the inner gerotor includes a second swash plate with a second radial wall that radially overlaps the second lobes and the arcuate surfaces of the wobble cancellation element, and n second fluid ports each radially aligned with a one of the first depressions. In an example embodiment, the outer gerotor has n+1 third lobes, each aligned with an outer depression, and, when an adjacent pair of first depressions is aligned with an adjacent pair of third lobes, the outer gerotor entirely covers a one of the first fluid ports.

In some example embodiments, the first swash plate is disposed on a first axial side of the outer gerotor and the wobble cancellation element, and the second swash plate is disposed on a second axial side of the outer gerotor and the wobble cancellation element, opposite the first axial side. In an example embodiment, the gerotor pump is arranged to pump a fluid from the first fluid ports to the second fluid ports, or vice versa, when the outer gerotor is displaced relative to the inner gerotor.

In some example embodiments, the inner gerotor includes a first gear for driving engagement by a one of an internal combustion engine or an electric motor. In an example embodiment, the wobble cancellation element includes a second gear arranged for driving engagement by the other of the internal combustion engine or the electric motor. In an example embodiment, the gerotor pump includes a first bearing disposed radially between the inner gerotor and the wobble cancellation element. In an example embodiment, the gerotor pump includes a housing enclosing the inner gerotor, the wobble cancellation element, and the outer gerotor, a second bearing disposed radially between the inner gerotor and the outer gerotor, and a third bearing, axially offset from the second bearing and disposed radially between the housing and the inner gerotor.

In some example embodiments, the inner gerotor includes a first hollow shaft. In some example embodiments, the wobble cancellation element includes a distributor, and the distributor includes a second hollow shaft coaxial with the first hollow shaft. In an example embodiment, the gerotor pump includes a housing enclosing the inner gerotor, the wobble cancellation element, and the outer gerotor, and a fourth bearing disposed radially between the housing and the distributor.

In some example embodiments, the inner gerotor includes a first hollow shaft and a first swash plate. The first swash plate has a first radial wall that radially overlaps the second lobes and the arcuate surfaces of the wobble cancellation element, and n first fluid ports disposed in the first radial wall, each one of the n first fluid ports radially aligned with a one of the first lobes. The wobble cancellation element includes a distributor with a second hollow shaft coaxial with the first hollow shaft, and a second radial wall. The inner gerotor and the wobble cancellation element form at least a portion of a chamber for receiving a fluid, the distributor includes a plurality of radial holes fluidly connecting the second hollow shaft to the chamber, and the chamber is fluidly connected to the first fluid ports.

In some example embodiments, the gerotor pump includes a housing enclosing the inner gerotor, the wobble cancellation element, and the outer gerotor. The inner gerotor includes a second swash plate with a second radial wall that axially overlaps the second lobes and the arcuate surfaces of the wobble cancellation element, and n second fluid ports each radially aligned with a one of the first depressions. The housing includes a plurality of circumferential slots at least partially aligned with the second fluid ports. In an example embodiment, the housing includes a cover with a radial groove at least partially aligned with the first hollow shaft, and a circumferential groove at least partially aligned with the plurality of circumferential slots.

DETAILED DESCRIPTION

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
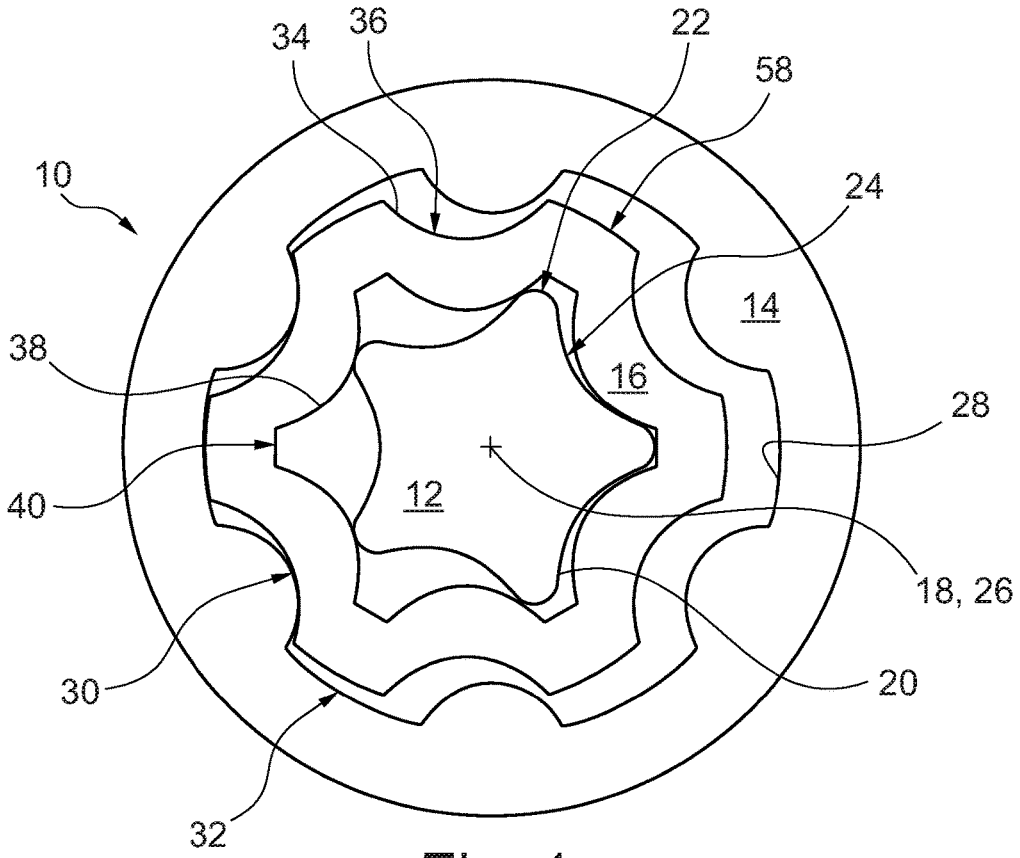
FIG. 1 illustrates an end schematic view of a gerotor pump according to a first example embodiment.

The following description is made with reference to FIG. 1. FIG. 1 illustrates a front schematic view of gerotor pump 10 according to a first example embodiment. Gerotor pump 10 includes an inner gerotor 12, wobble cancellation element, or lobed ring, 14, and outer gerotor 16 disposed radially between the inner gerotor and the wobble cancellation element. The inner gerotor includes rotational axis 18 and outer peripheral surface 20. The inner gerotor includes five lobes 22 equally spaced from one another in a circumferential direction, and five depressions 24, each disposed between an adjacent pair of first lobes. Although five lobes and depressions are shown, other numbers of lobes and depressions are possible. For example, in another example embodiment (not shown), inner gerotor 12 may include four or six lobes and depressions.

The wobble cancellation element includes rotational axis 26 aligned with rotational axis 18 such that the inner gerotor and the wobble cancellation element are coaxial. The wobble cancellation element also includes inner peripheral surface 28 including six lobes 30 equally spaced from one another in the circumferential direction and six arcuate surfaces 32, each arranged between an adjacent pair of lobes 30. Although six lobes and arcuate surfaces are shown, other numbers of lobes and arcuate surfaces are possible. For example, wobble cancellation element 16 may include five or seven lobes and arcuate surfaces. It should be noted that the number of lobes 22 is exactly one less than the number of lobes 30. In other words, if inner gerotor 12 has n lobes 22 then wobble cancellation element includes n+1 lobes 30.

The outer gerotor includes outer peripheral surface 34 including six outer depressions 36 complementary to and arranged to engage the lobes 30, inner peripheral surface 38 including six inner depressions 40 complementary to and arranged to engage lobes 22. Although six outer depressions and inner depressions are shown, other numbers are possible. For example, outer gerotor 16 may include five or seven outer depressions and inner depressions. For the example used above, the outer gerotor would have n+1 outer depressions and inner depressions, the same as the number of lobes 30 and arcuate surfaces for wobble cancellation element 14.

Each of the outer depressions of the outer gerotor remains aligned with a same lobe 30 of the wobble cancellation element when the inner gerotor is rotated relative to the wobble cancellation element. Each of the inner depressions of the outer gerotor translates between different lobes 22 of the inner gerotor when the inner gerotor is rotated relative to the wobble cancellation element. The outer gerotor is free to float between the inner gerotor and the wobble cancellation element. During operation of the gerotor pump, the outer gerotor translates rotationally when the wobble cancellation element is rotated and the inner gerotor is fixed, and the outer gerotor moves but does not translate rotationally when the inner gerotor is rotated and the wobble cancellation element is fixed.

Figure 2:
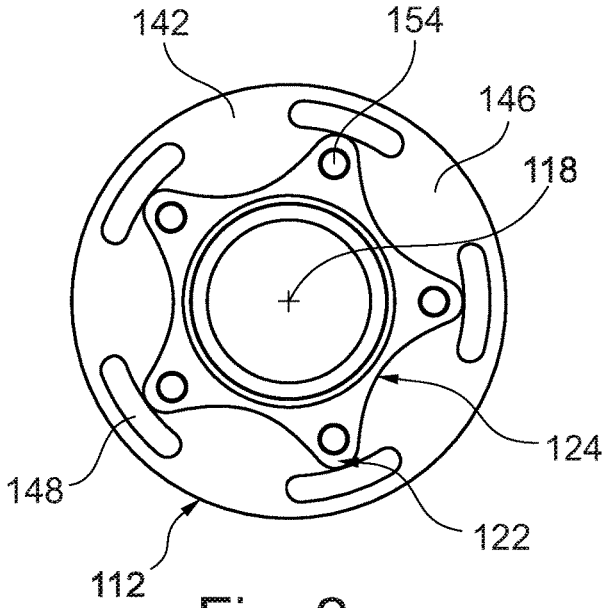
FIG. 2 illustrates an end view of a portion of an inner gerotor showing a first swash plate for a gerotor pump according to a second example embodiment.
Figure 3:
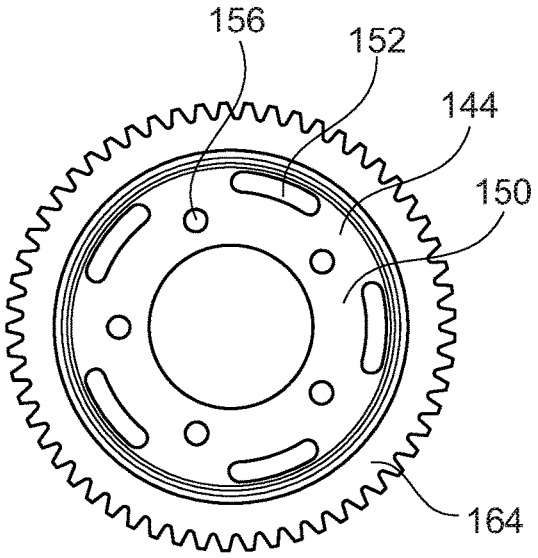
FIG. 3 illustrates an end view of a second swash plate of the inner gerotor of FIG. 2.
Figure 4:
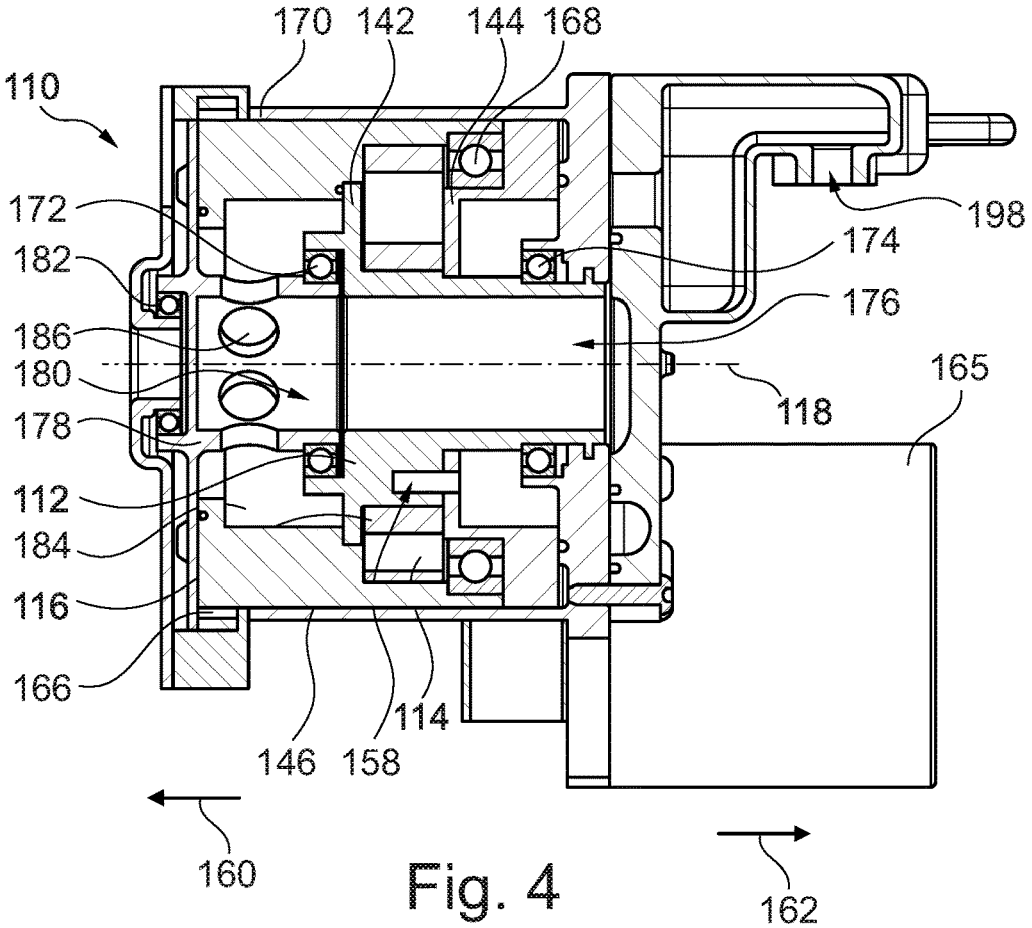
FIG. 4 illustrates a cross sectional view of a gerotor pump including the inner gerotor of FIG. 2.

The following description is made with reference to FIGS. 2-4. FIG. 2 illustrates an end view of a portion of inner gerotor 112 showing swash plate 142 for gerotor pump 110 according to a second example embodiment. FIG. 3 illustrates an end view of swash plate 144 of inner gerotor 112 of FIG. 2. FIG. 4 illustrates a cross sectional view of gerotor pump 110 including inner gerotor 112 of FIG. 2. Gerotor pump 110 is generally similar to gerotor pump 10 with features labeled 1XX where XX is a similar feature on gerotor pump 10. The above description of gerotor pump 10 generally applies to gerotor pump 110 except as described below. Inner gerotor 112 includes swash plate 142. Swash plate 142 includes radial wall 146 that radially overlaps lobes 130 and arcuate surfaces 132 of wobble cancellation element 114 (ref. FIG. 4), five fluid ports 148 disposed in the radial wall, each one radially aligned with a one of the lobes 122. In this context, radially overlaps means a straight line radially offset from and parallel to axis 118 passes through both radial wall 146, and lobe 130 or arcuate surface 132. Radially aligned means that a straight radial line extending from axis 118 passes through both a lobe 122 and a fluid port 148.

Inner gerotor 110 includes swash plate 144 with radial wall 150 that radially overlaps lobes 130 and arcuate surfaces 132 of the wobble cancellation element, and five fluid ports 152 each radially aligned with a one of depressions 124. Swash plates 142 and 144 include respective bores 154 and 156 for receiving pins 158 (ref. FIG. 4) for aligning the swash plates relative to one another. As can be seen in FIGS.

2 and 3, bores 154 are aligned with fluid ports 148 and bores 156 are circumferentially offset from fluid ports 152 such that ports 148 are aligned with lobes 122 and, when assembled, ports 152 are aligned with depressions 124. Outer gerotor 116 includes six lobes 158 (or n+1 lobes in the scenario discussed above), each aligned with an outer depression 136, and, when an adjacent pair of depressions 124 is aligned with an adjacent pair of lobes 122, the outer gerotor entirely covers a one of fluid ports 148 (as discussed with reference to FIG. 8 below).

As best viewed in FIG. 4, swash plate 142 is disposed on axial side 160 of the outer gerotor and the wobble cancellation element, and swash plate 144 is disposed on axial side 162 of the outer gerotor and the wobble cancellation element, opposite axial side 160. As outer gerotor 116 covers and uncovers fluid ports 148 and 152, gerotor pump 110 is arranged to pump a fluid from fluid ports 148 to fluid ports 152, or vice versa, when the outer gerotor is displaced relative to the inner gerotor.

Figure 5:
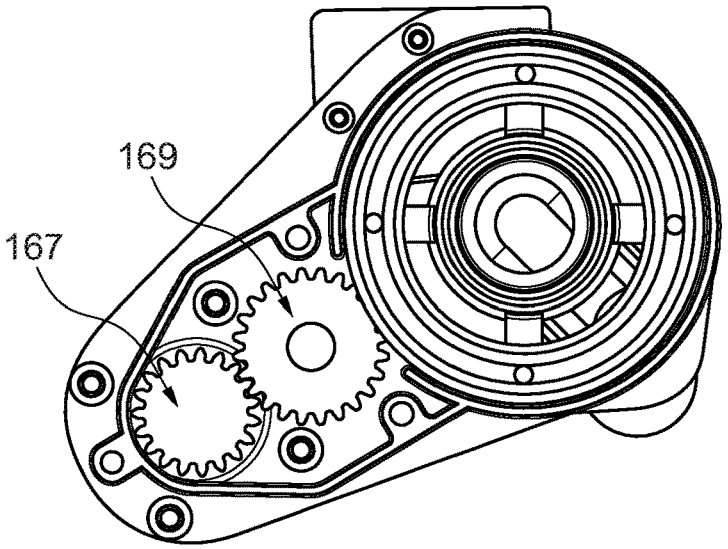
FIG. 5 illustrates a cross section view of the gerotor pump of FIG. 4 showing an electric motor gear train.

The following description is made with reference to FIGS. 2-5. FIG. 5 illustrates a cross section view of gerotor pump 110 of FIG. 4 showing an electric motor gear train. Inner gerotor 112 includes gear 164 (ref. FIG. 3, disposed on swash plate 144) for driving engagement by electric motor 165 via motor gear 167 and idler gear 169 (ref. FIG. 5). Similarly, wobble cancellation element 114 includes gear 166 (ref. FIG. 4) arranged for driving engagement by an internal combustion engine (not shown). Although gear 164 is shown engaged with motor 165 other embodiments are possible. For example, gear 164 may be engaged with an internal combustion engine and gear 166 may be engaged with motor 165.

Gerotor pump 110 includes bearing 168 is disposed radially between the inner gerotor and the wobble cancellation element. Gerotor pump 110 also includes housing 170 enclosing the inner gerotor, the wobble cancellation element, and the outer gerotor, bearing 172 disposed radially between the inner gerotor and the wobble cancellation element, and bearing 174, axially offset from bearing 172 and disposed radially between the housing and the inner gerotor.

Inner gerotor 112 includes hollow shaft 176. Wobble cancellation element 114 includes distributor 178 with hollow shaft 180 coaxial with hollow shaft 176. Bearing 182 is disposed radially between the housing and the distributor. Inner gerotor 112 and wobble cancellation element 114 form a portion of a chamber 184 for receiving a fluid. Distributor 178 includes radial holes 186 fluidly connecting hollow shaft 180 to the chamber. Chamber 184 is fluidly connected to fluid ports 148.

Figure 6:
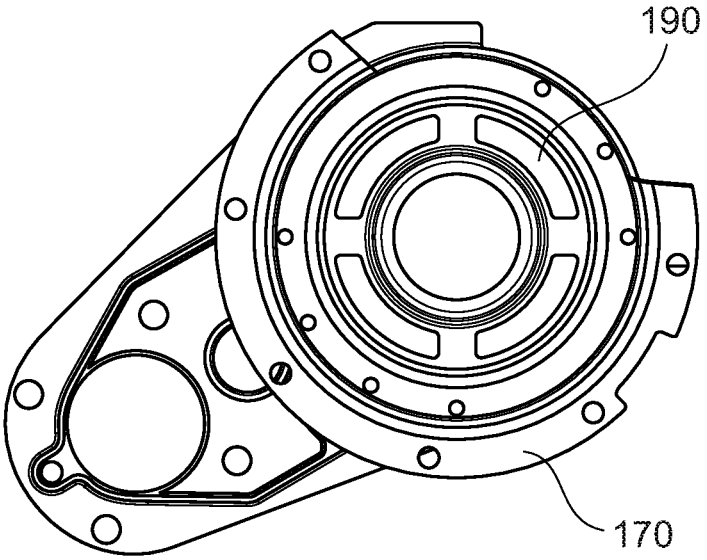
FIG. 6 illustrates an end view showing a portion of a housing for the gerotor pump of FIG. 4.
Figure 7:
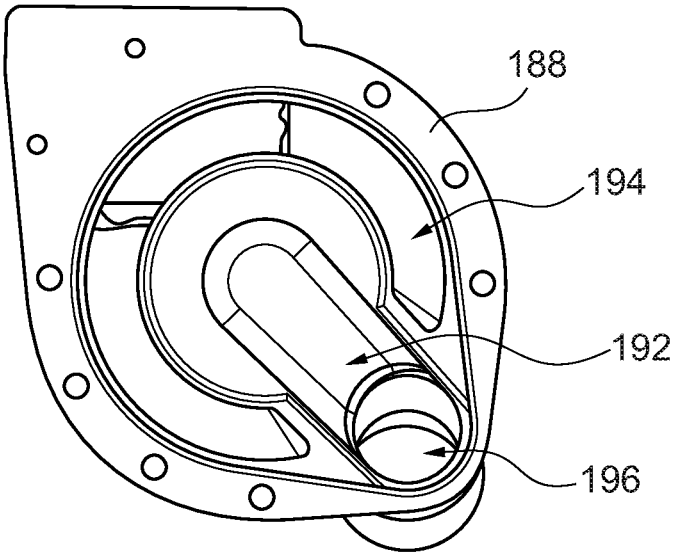
FIG. 7 illustrates an end view showing a cover of the housing of FIG. 6.

The following description is made with reference to FIGS. 4-7. FIG. 6 illustrates an end view showing a portion of housing 170 for gerotor pump 110 of FIG. 4. FIG. 7 illustrates an end view showing cover 188 of housing 170 of FIG. 6. Housing 170 includes circumferential slots 190 partially aligned with fluid ports 152 disposed in swash plate 144. In this context, partially aligned means that the slots and fluid ports are disposed at a same radius so that, as swash plate 144 rotates, various ports 152 align with various slots 190 such that a fluid can flow to or from pump 110. Housing 170 includes cover 188 with radial groove 192 at least partially aligned with hollow shaft 176, and circumferential groove 194 at least partially aligned with circumferential slots 190. So, during operation of gerotor pump 110, fluid flows into cover opening 196, through radial groove 192 to hollow shaft 176 and hollow shaft 180, out radial holes 186 into chamber 184, through fluid ports 148 in swash plate 142 and fluid ports 152 in swash plate, through slots 190 into groove 194 and out through cover opening 198 (ref. FIG. 4). Although pump 110 is described as moving fluid from opening 196 to opening 198, it is also possible to move fluid from opening 198 to 196 if the rotation direction is reversed.

Figure 8:
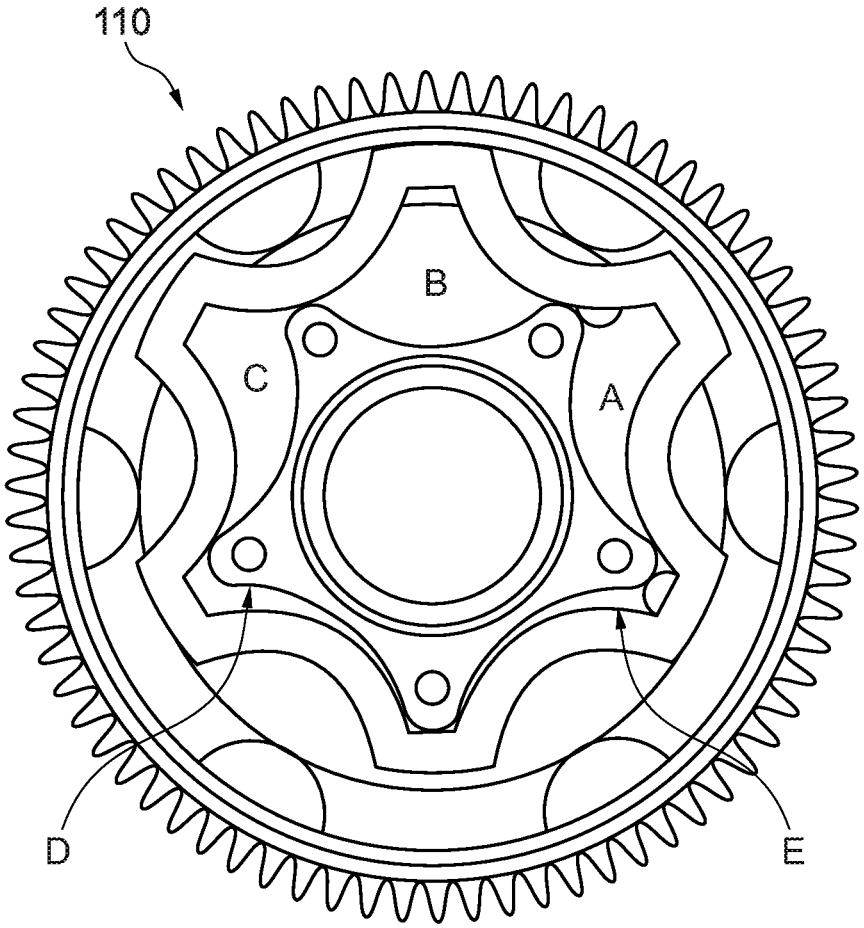
FIG. 8 illustrates a cross-section view of the gerotor pump of FIG. 4 showing various fluid volumes.

The following description is made with reference to FIGS. 1-8. FIG. 8 illustrates a cross-section view of gerotor pump 110 of FIG. 4 showing various fluid volumes. Gears 164 and 166 (i.e., dual inputs) permit pump 110 to be operated in various modes. The first mode involves rotation of the inner gerotor while the lobed ring, or wobble cancellation element, is stationary. The outer gerotor floats and is constrained both axially and radially by the inner gerotor and lobed ring. As the inner gerotor rotates, the outer gerotor comes into contact with both the inner gerotor and the lobed ring. Geometry forces the outer gerotor to translate in a circular motion about the inner gerotor's rotational axis. The circle's radius is equal to the eccentricity between the inner gerotor's rotational axis and the outer gerotor's rotational axis. The outer gerotor's motion causes the volumes formed between the inner gerotor and the outer gerotor to either enlarge or contract. These volumes shown in FIG. 8 are labeled A through E. Increasing volumes create pockets of low pressure, developing a suction effect. Decreasing volumes generate areas of high pressure, forming a pumping action.

For useful, unidirectional flow to emerge, each volume must be exposed to only one of either the inlet or the outlet fluid. Swash plates provide a method for accomplishing this end. Each swash plate has holes cut through it so that fluid may enter or exit the corresponding expanding or contracting volumes. The geometry of the holes is such that the relative motion between the inner gerotor and outer gerotor uncovers or covers the ports so that either suction or pumping action can be formed. At any given time, all expanding volumes will be open to the inlet fluid, and all contracting volumes will be open to the outlet fluid. To keep the relative motion consistent between the inner and outer gerotors, ensuring proper porting, both swash plates rotate together.

The second mode of operation is similar to the first. Suction and pumping action is created through the same mechanism of expanding and contracting volumes created by the relative motion of the inner gerotor and the outer gerotor. However, for the second mode, the lobed ring rotates while the inner gerotor is held fixed. Again, the outer gerotor floats and is constrained axially and radially by the geometry of the inner gerotor and the lobed ring. As the lobed ring rotates, the outer gerotor is geometrically forced in a precession around the inner gerotor. Similar to the first mode, the outer gerotor translates in a circular path around the inner gerotor's rotational axis. However, this mode of operation also introduces a rotation of the outer gerotor about its own rotational axis equal to the same angular velocity as the lobed ring.

The third mode of operation is a superposition of the first two modes. In this mode, both the inner gerotor and the lobed ring are rotated while the outer gerotor floats. If the inner gerotor and lobed ring are rotated in opposite directions, the relative velocity between the outer gerotor and the inner gerotor increases, providing an increased fluid flow rate and a pump boost. Rotation of the inner gerotor and the lobed ring in the same direction, has the opposite effect.

Independent of operation mode, fluid enters and exits through separated channels in a cover adapted to the particular application. The cover's inlet channel connects to another channel cut through the inner gerotor's center.

Eventually, the fluid runs into the distributor portion of the lobed ring. Holes in the distributor allow the fluid to enter the sealed suction chamber formed by the distributor, inner gerotor and lobed ring. Fluid is then drawn into and pumped through the gerotor section. The fluid then ends up in the sealed pressure chamber formed by the outlet swash plate and the housing. Holes in the housing permits fluid flow into the outlet channel of the cover for its final exit. The housing surrounds all of the moving components for safety and provides support for the structure.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

REFERENCE NUMERALS

10 Gerotor pump
12 Inner gerotor
14 Outer wobble cancellation element
16 Outer gerotor
18 Rotational axis (first)
20 Outer peripheral surface (first)
22 Lobes (first)
24 Depressions (first)
26 Rotational axis (second)
28 Inner peripheral surface (first)
30 Lobes (second)
32 Arcuate surfaces
34 Outer peripheral surface (second)
36 Outer depressions
38 Inner peripheral surface (second)
40 Inner depressions
110 Gerotor pump
112 Inner gerotor
114 Wobble cancellation element
116 Outer gerotor
118 Rotational axis (first)
120 Outer peripheral surface (first)
122 Lobes (first)
124 Depressions (first)
126 Rotational axis (second)
128 Inner peripheral surface (first)
130 Lobes (second)
132 Arcuate surfaces
134 Outer peripheral surface (second)
136 Outer depressions
138 Inner peripheral surface (second)
140 Inner depressions
142 Swash plate (first)
144 Swash plate (second)
146 Radial wall (first)
148 Fluid ports (first)
150 Radial wall (second)
152 Fluid ports (second)
154 Bores (first swash plate)
156 Bores (second swash plate)
158 Lobes (third)
160 Axial side (first)
162 Axial side (second)
164 Gear (first)
165 Electric motor
166 Gear (second)
167 Motor gear
168 Bearing (first)
169 Idler gear
170 Housing
172 Bearing (second)
174 Bearing (third)
176 Hollow shaft (first)
178 Distributor
180 Hollow shaft (second)
182 Bearing (fourth)
184 Chamber
186 Radial holes
188 Cover
190 Circumferential slots
192 Radial groove
194 Circumferential groove
196 Cover opening (first)
198 Cover opening (second)

What is claimed is:

1. A gerotor pump, comprising:
an inner gerotor, comprising:
a first rotational axis; and
a first outer peripheral surface, comprising:
n first lobes equally spaced from one another in a circumferential direction; and
n first depressions, each disposed between an adjacent pair of first lobes;
a wobble cancellation element, comprising:
a second rotational axis aligned with the first rotational axis such that the inner gerotor and the wobble cancellation element are coaxial; and
a first inner peripheral surface, comprising:
n+1 second lobes equally spaced from one another in the circumferential direction; and
n+1 arcuate surfaces, each arranged between an adjacent pair of second lobes; and
an outer gerotor disposed radially between the inner gerotor and the wobble cancellation element, comprising:
a second outer peripheral surface comprising n+1 outer depressions complementary to and arranged to engage the second lobes; and
a second inner peripheral surface comprising n+1 inner depressions complementary to and arranged to engage the first lobes.

2. The gerotor pump of claim 1 wherein each of the outer depressions of the outer gerotor remains aligned with a same second lobe of the wobble cancellation element when the inner gerotor is rotated relative to the wobble cancellation element.

3. The gerotor pump of claim 1 wherein each of the inner depressions of the outer gerotor translates between different first lobes of the inner gerotor when the inner gerotor is rotated relative to the wobble cancellation element.

4. The gerotor pump of claim 1 wherein the outer gerotor is free to float between the inner gerotor and the wobble cancellation element.

5. The gerotor pump of claim 1 wherein, during operation of the gerotor pump:

the outer gerotor translates rotationally when the wobble cancellation element is rotated and the inner gerotor is fixed; and the outer gerotor moves but does not translate rotationally when the inner gerotor is rotated and the wobble cancellation element is fixed.

6. The gerotor pump of claim 1 wherein the inner gerotor comprises a first swash plate comprising:

a first radial wall that radially overlaps the second lobes and the arcuate surfaces of the wobble cancellation element; and n first fluid ports disposed in the first radial wall, each one of the n first fluid ports radially aligned with a one of the first lobes.

7. The gerotor pump of claim 6 wherein the inner gerotor comprises a second swash plate comprising:

a second radial wall that radially overlaps the second lobes and the arcuate surfaces of the wobble cancellation element; and n second fluid ports each radially aligned with a one of the first depressions.

8. The gerotor pump of claim 7 wherein the outer gerotor comprises n+1 third lobes, each aligned with an outer depression, and, when an adjacent pair of first depressions is aligned with an adjacent pair of third lobes, the outer gerotor entirely covers a one of the first fluid ports.

9. The gerotor pump of claim 7 wherein:

the first swash plate is disposed on a first axial side of the outer gerotor and the wobble cancellation element; and the second swash plate is disposed on a second axial side of the outer gerotor and the wobble cancellation element, opposite the first axial side.

10. The gerotor pump of claim 9 wherein the gerotor pump is arranged to pump a fluid from the first fluid ports to the second fluid ports, or vice versa, when the outer gerotor is displaced relative to the inner gerotor.

11. The gerotor pump of claim 1 wherein the inner gerotor comprises a first gear for driving engagement by a one of an internal combustion engine or an electric motor.

12. The gerotor pump of claim 11 wherein the wobble cancellation element comprises a second gear arranged for driving engagement by the other of the internal combustion engine or the electric motor.

13. The gerotor pump of claim 1 further comprising a first bearing disposed radially between the inner gerotor and the wobble cancellation element.

14. The gerotor pump of claim 1 further comprising:

a housing enclosing the inner gerotor, the wobble cancellation element, and the outer gerotor;

a second bearing disposed radially between the inner gerotor and the outer gerotor; and a third bearing, axially offset from the second bearing and disposed radially between the housing and the inner gerotor.

15. The gerotor pump of claim 1 wherein the inner gerotor comprises a first hollow shaft.

16. The gerotor pump of claim 15 wherein:

the wobble cancellation element comprises a distributor; and the distributor comprises a second hollow shaft coaxial with the first hollow shaft.

17. The gerotor pump of claim 16 further comprising:

a housing enclosing the inner gerotor, the wobble cancellation element, and the outer gerotor; and a fourth bearing disposed radially between the housing and the distributor.

18. The gerotor pump of claim 1 wherein:

the inner gerotor comprises:

a first hollow shaft; and a first swash plate comprising:

a first radial wall that radially overlaps the second lobes and the arcuate surfaces of the wobble cancellation element; and n first fluid ports disposed in the first radial wall, each one of the n first fluid ports radially aligned with a one of the first lobes;

the wobble cancellation element comprises a distributor comprising:

a second hollow shaft coaxial with the first hollow shaft; and a second radial wall;

the inner gerotor and the wobble cancellation element form at least a portion of a chamber for receiving a fluid;

the distributor comprises a plurality of radial holes fluidly connecting the second hollow shaft to the chamber; and the chamber is fluidly connected to the first fluid ports.

19. The gerotor pump of claim 18 further comprising a housing enclosing the inner gerotor, the wobble cancellation element, and the outer gerotor, wherein:

the inner gerotor comprises a second swash plate comprising:

a second radial wall that axially overlaps the second lobes and the arcuate surfaces of the wobble cancellation element; and n second fluid ports each radially aligned with a one of the first depressions; and the housing comprises a plurality of circumferential slots at least partially aligned with the second fluid ports.

20. The gerotor pump of claim 19 wherein the housing comprises a cover comprising:

a radial groove at least partially aligned with the first hollow shaft; and a circumferential groove at least partially aligned with the plurality of circumferential slots.

* * * * *